US005480843A

United States Patent [19]

Park et al.

[11] Patent Number: 5,480,843

[45] Date of Patent: Jan. 2, 1996

[54] METHOD FOR MAKING A FIELD EMISSION DEVICE

[75] Inventors: Nam-sin Park; Seon-jeong Choi, both of Kyunggi-do, Rep. of Korea

[73] Assignee: Samsung Display Devices Co., Ltd., Kyunggi-do, Rep. of Korea

[21] Appl. No.: 195,772

[22] Filed: Feb. 10, 1994

[51] Int. Cl.[6] ..... H01J 9/04

[52] U.S. Cl. ..... 437/228; 445/50

[58] Field of Search ..... 437/203, 228; 156/644, 659.1; 29/25.01, 25.02; 445/49, 50; 313/336

[56] References Cited

U.S. PATENT DOCUMENTS

| | | | |
|---|---|---|---|
| 4,095,133 | 6/1978 | Hoeberechts | 156/657 |
| 4,168,213 | 9/1979 | Hoeberechts | 156/659.1 |
| 5,007,873 | 4/1991 | Goronkin et al. | 445/49 |
| 5,055,077 | 10/1991 | Kane | 445/50 |
| 5,064,396 | 11/1991 | Spindt | 445/50 |
| 5,075,591 | 12/1991 | Holmberg | 313/495 |
| 5,136,764 | 8/1992 | Vasquez | 437/228 |
| 5,228,877 | 7/1993 | Allaway et al. | 156/659.1 |
| 5,229,682 | 7/1993 | Komatsu | 313/309 |
| 5,249,340 | 10/1993 | Kane et al. | 437/203 |
| 5,258,685 | 11/1993 | Jaskie et al. | 313/309 |
| 5,278,472 | 1/1994 | Smith et al. | 313/309 |
| 5,312,777 | 5/1994 | Cronin et al. | 437/203 |
| 5,362,677 | 11/1994 | Sakamoto et al. | 437/203 |
| 5,371,431 | 12/1994 | Jones et al. | 313/309 |

FOREIGN PATENT DOCUMENTS 61-221783 of 1986 Japan .

*Primary Examiner*—R. Bruce Breneman
*Assistant Examiner*—Matthew Whipple
*Attorney, Agent, or Firm*—Christie, Parker & Hale

[57] ABSTRACT

A method for making a field emission cathode in layers by first forming a conical-section shaped layer, a truncated buffer layer, and on top of it forming a cathode conical-tip-shaped layer so that the cathode yields a uniform emission brightness and is capable of emitting electrons for a long time, and so that the cathode is not prone to tip breakage when current is excessively applied only to a portion of the cathode.

11 Claims, 3 Drawing Sheets

METHOD FOR MAKING A FIELD EMISSION DEVICE

BACKGROUND OF THE INVENTION

1. Field of the Invention

The present invention relates to a method for making a field emission device used for various displays, light sources, high speed switching devices, microsensors and so on from which electrons are emitted by a field effect among electron sources. More particularly, it relates to a method for making a field emission cathode having a microtip.

2. Description of the Prior Art

Flat panel displays for wall television sets may be either a liquid crystal display (LCD), a plasma display panel (PDP), or a field emission device (FED). The field emission device may have very high luminous efficiency and luminescence by highly integrating the tips of the field emission material to $10^4$–$10^5$ Tips/$m^2$, and thereby reducing voltage consumption.

FIG. 3 is a view illustrating a typical prior art structure of the field emission device. A reference numeral 31 indicates a substrate doped with impurities of high density and having high conductivity. A cathode made of molybdenum Mo serving as an electron emission device 36 is formed in a cavity 35 between insulating layers 34 on the substrate 31. In addition, a gate electrode 38, surrounding the cathode 36, and made of a molybdenum thin film is deposited on the insulating layers 34.

For example, by biasing the gate electrodes 38 within the range of tens to hundreds of volts to the substrate 31, an electronic field of about $10^6$ V/cm–$10^7$ V/cm is generated between a tip of the cone-shaped cathode 36 and the gate electrodes 38, and thus an emission current of about several hundreds of mA can be obtained from the tip of the cathode 36.

FIG. 4 illustrates a perspective view of a prior art display using a field emission device as the electron source (refer to Japan Patent Unexamined Publication Sho 61-221783).

Referring to FIG. 4, a plurality of cathode electrodes 42 is formed on a lower glass 40 in accordance with the directions of rows 41, and a cone-shaped field emission device 46 and an insulting layer 44 are formed on the cathode electrode 42. Also, a plurality of gate electrodes 48 is formed on the insulting layer 44 in accordance with the directions of columns 45. Cavities or holes are formed at the opposite side of the cone-shaped field emission device 46 of the gate electrode 48.

Meantime, a transparent conductive layer 52 and a fluorescent layer 54 are respectively deposited to the lower glass 40 and to the upper glass 50 to be fixed in a beta configuration. The lower substrate 40 and the upper substrate 50 together with a spacer (not shown) form the outside of a vacuum-tube.

Positive electric potential is applied to the transparent conductive layer 52. Responsive to a display signal, a predetermined electric potential difference is given between the cathode electrode 42 in the rows 41 and the gate electrode 48 in the columns 45. An appropriate electric field is formed between the gate electrode 48 and the cone-shaped field emission cathode 46, such that electrons are emitted from a cone-shaped tip. When electrons are emitted from the cavity of the gate electrode 48 to the opposite fluorescent layer 54, the fluorescent layer 54 is excited and radiates. An image in accordance with the display signal is displayed by the above-mentioned operation.

By making the diameter of the tip of cathode 46 tens of namometers the prior art field emission device does not have any problems in forming the high field required for emitting the electrons from the tip of the cathode. However, there are disadvantages in the display operation. When the electron emission from the plurality of tips of the cathodes is induced, the tips of the cathodes break or wear out due to current concentration on a predetermined cathode. Further, there is the problem that brightness around a predetermined portion in the phosphor layer is abnormally greater than around the remaining portion. This creates an instability in emission brightness since electron emission power from the tip of the cathode is not stable. In addition, if the tip of the cathode falls off, the electron emission yield is reduced since during the etching process, etching material permeates into the contact portion between the cathode and the cathode electrode forming the cathode tip array.

SUMMARY OF THE INVENTION

The present invention is directed to an emission device which substantially obviates one or more of the problems inherent in the limitations and disadvantages of the prior art devices. The present invention is directed to a method for making a field emission device by which uniformity of an emission brightness can be embodied.

To achieve this and other advantages in accordance with the purpose of the invention as embodied and broadly described herein, a method for making a field emission device comprises: a first step of forming a plurality of cavities by photo-etching a gate electrode and a predetermined portion of an insulating layer after depositing a plurality of cathode electrodes on a substrate, insulating layers in accordance with the direction of the pixel columns on the cathode electrodes, and a plurality of gate electrodes on the insulating layer in accordance with the direction of the pixel rows; a second step of forming a parting layer by rotating a sample in through the first step which is inclined at an angle of about 75 degrees from a central axis and concurrently depositing metal by an e-beam evaporator; a third step of forming a truncated buffer layer having a plane tip on the cathode electrode by a deposition through the cavity of which the diameter narrows by the second step; a fourth step of forming a cone-shaped field emission cathode tip on the truncated buffer layer by the same process as that of the third step; and a fifth step of lifting all of the layers deposited on the parting layer and the parting layer.

Another object of the present invention is to provide a plurality of field emission cathodes made by the above-mentioned steps for a uniform electron emission, wherein the lower portion of the field emission cathode is formed as a truncated buffer layer and the upper portion as a cone-shaped cathode tip. The buffer layer is made of either $SiO_2$, $In_2O_3$ or $SnO_2$ as required for improved adhesion with the cathode tip of the upper portion.

It is to be understood that both the foregoing general description and the following detailed description are exemplary and explanatory, and are intended to provide further explanation of the invention as claimed.

The accompanying drawings are included to provide a further understanding of the invention and constitute a part of this specification. They illustrate one embodiment of the invention and together with the description serve to explain the principles of invention.

DETAILED DESCRIPTION OF THE PREFERRED EMBODIMENT

Figure 1:
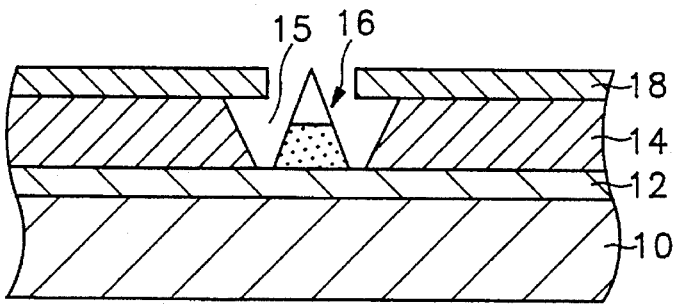
FIG. 1 is a sectional view illustrating a structure of a field emission device in accordance with a preferred embodiment of the present invention.

FIG. 1 is a sectional view illustrating the structure of a field emission device in accordance with a preferred embodiment of the present invention. FIGS. 2A to 2E are sectional views illustrating steps for making a field emission device in accordance with the embodiment of the present invention. The same reference numerals are given to the same portions for ease of illustration.

Referring to FIG. 1, a plurality of cathode electrodes 12 is formed on a lower substrate 10 in accordance with the directions of pixel columns, and a cathode 16 for electron emission and an insulating layer 14 are formed on the cathode electrodes 12. In addition, a plurality of gate electrodes 18 is formed on the insulating layer 14 in accordance with the direction of the pixel rows, and cavities are formed opposite each other between the gate electrodes 18 and the cathode 16.

The cathode 16 for field emission has an multilayer structure having a upper portion and a lower portion made from different materials rather than having a single material. The multilayer structure of the cathode will be described hereinafter.

FIGS. 2A to 2E are sectional views illustrating steps for making a field emission device in accordance with the embodiment of the present invention.

Figure 2A:
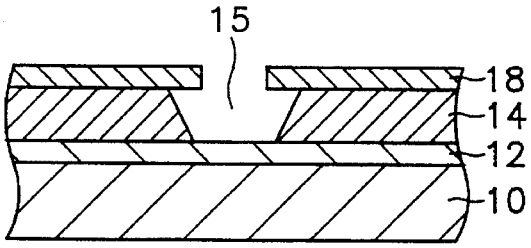
FIGS. 2A to 2E are sectional views illustrating steps for making a field emission device in accordance with the embodiment of the present invention.

FIG. 2A illustrates a first step for forming cavities 15 from a sample where the cathode electrode 12, the insulating layer 14 and gate electrode 18 are deposited on the lower glass 10, respectively.

The cathode electrode 12 is formed in a line electrode group having a pattern where width of the lines are about 200 micrometers, and the distances between the lines are about 100 micrometers in accordance with the directions of the pixel columns. The cathode electrode 12 is made of a metal deposited, with a thickness of 2000 to 4000 angstroms like aluminum, chromium or molybdenum and the like. In addition, the insulating layer 14 is made of $SiO_2$ having a thickness of 1 nanometer to 1.5 micrometers deposited by PECVD or sputtering generally used for making a semiconductor. The distance between the gate electrode 18 and the cathode electrode 12 is determined by the thickness of the insulating layer 14. The thickness of the insulating layer 14 also influences the height of the cathode tip. The gate electrode 18 is made of a rare metal, molybdenum Mo, wolfram W, or niobium and the like having a thickness of 4000 angstroms. In addition, the cavity 15 is formed by photo-etching, or by a selective etching like a dry or a wet etching.

Figure 2B:
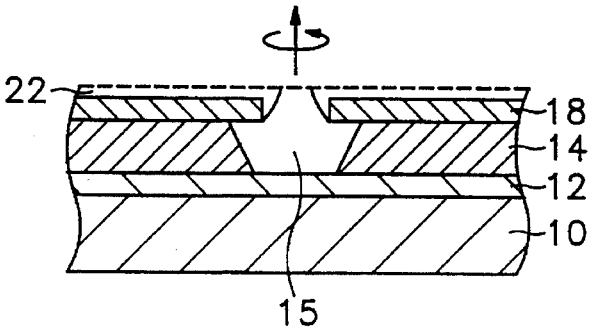

FIG. 2B illustrates a second step for forming a parting layer 22 by depositing nickel Ni or aluminum Al on the gate electrode 18, rotating the sample formed through the first step to have an inclination angle of about 75 degrees from a central axis. The parting layer 22 formed through the second step enables a microscopic cathode tip having a diameter of tens of nanometers to be formed in a following step by adjusting an aperture of the cavity 15.

Figure 2C:
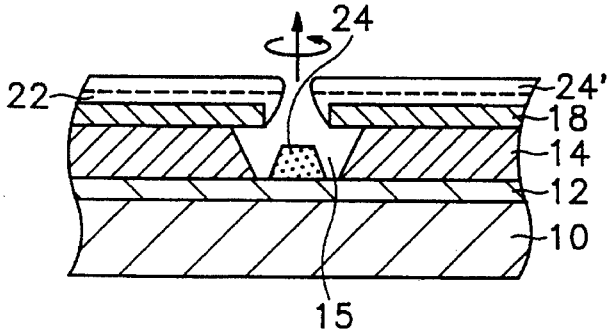

FIG. 2C illustrates a third step for forming a truncated buffer layer 24 having a plane tip on the cathode electrode 12. The truncated buffer layer is formed by deposition through the cavity 15 whose aperture is narrowed through the second step. A barrier layer 24' formed on the parting layer 22 concurrently with the forming of the buffer layer 24. The buffer layer 24 which is formed as high as the barrier layer 24' is made by depositing $SiO_2$, $In_2O_3$ or $SnO_2$ by an e-beam evaporator.

Figure 2D:
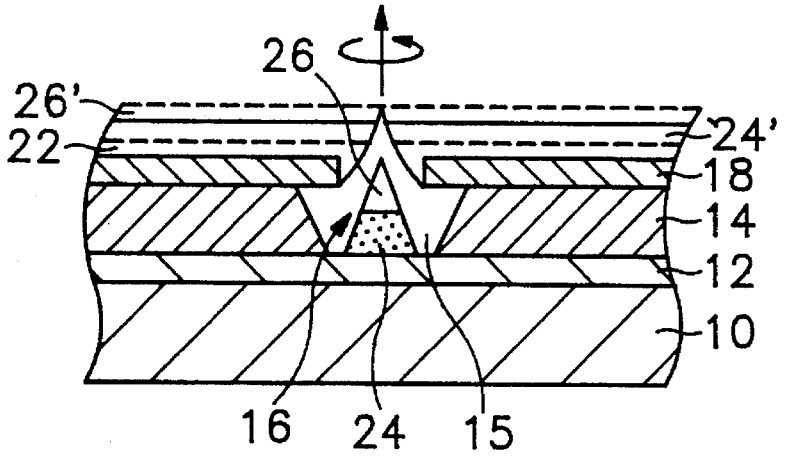

FIG. 2D illustrates a fourth step for forming a cone-shaped cathode tip 26 having a diameter of tens of nanometers on the buffer layer 24 in the cavity. The cathode tip is formed by the same method as that described in the third step. The cathode tip is made of molybdenum Mo or wolfram W, and has diameter of about 20 to 50 nanometers. The cone-shaped cathode tip is made at the point in time that a barrier layer 26' is completely covered.

Figure 2E:
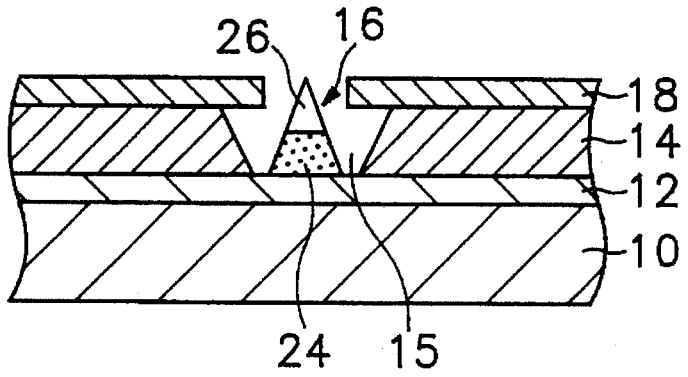
Figure 3:
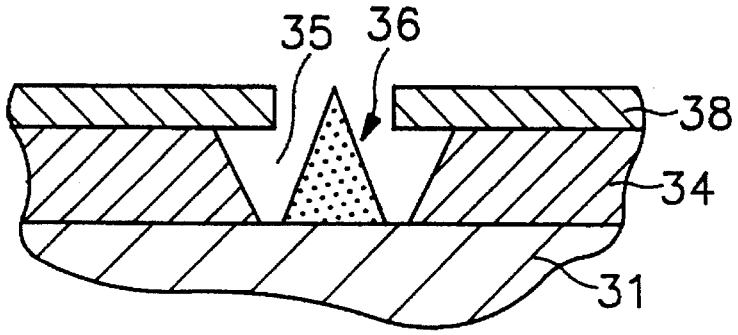
FIG.3 (Prior Art)
FIG. 3 is a sectional view illustrating a prior art field emission device.

FIG. 2E illustrates a final step for removing the parting layer 22 and the barrier layers 24' and 26' thereon. These layers 22, 24' and 26' are removed through a conventional lift-off.

Figure 4:
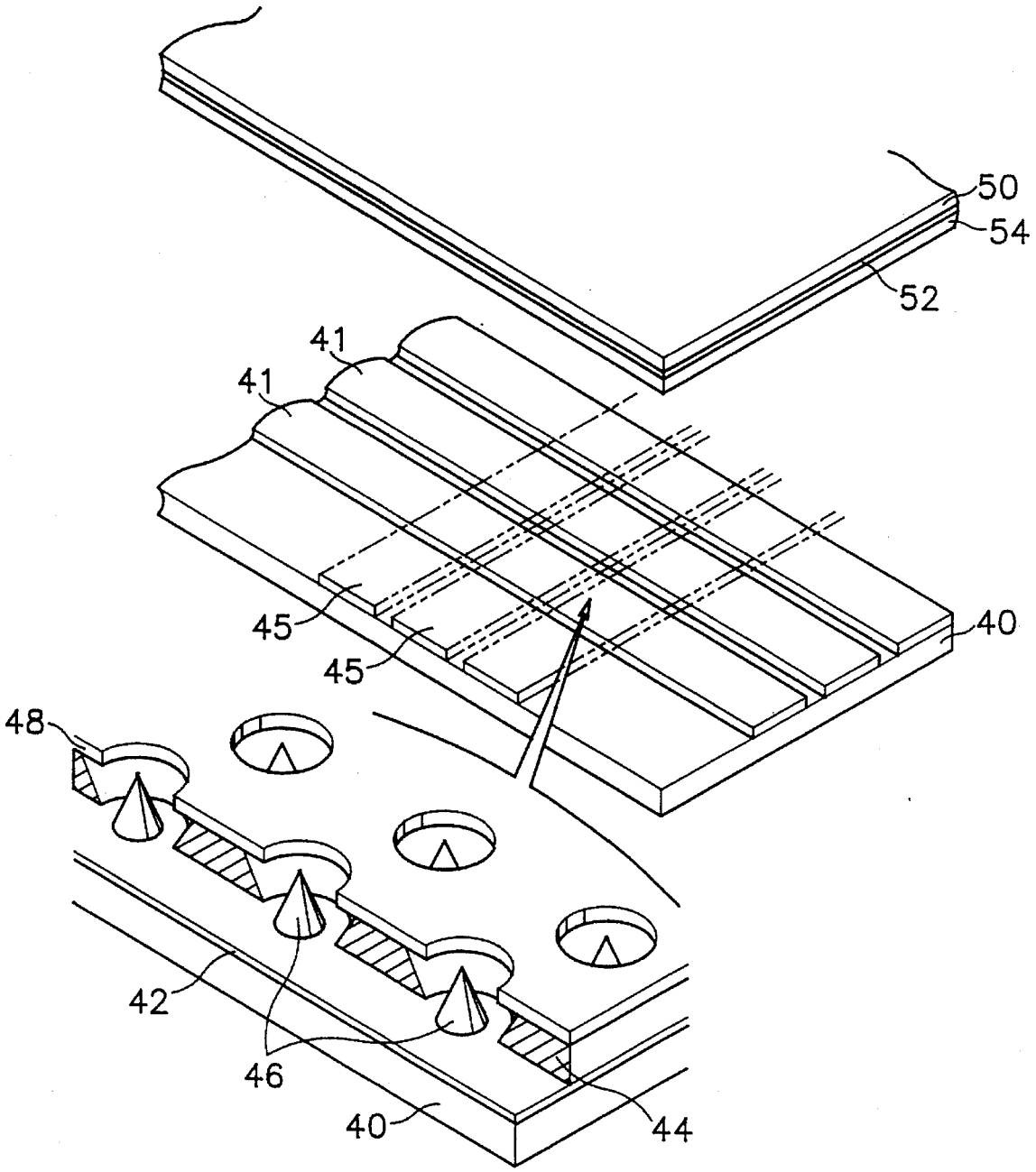
FIG.4(Prior Art)
FIG. 4 is a view illustrating a structure of a display device using the field emission device shown in FIG. 3.

Meantime, referring to FIG. 4, on an upper substrate opposite to the lower substrate 40, a transparent conductive layer and a fluorescent layer 48 are respectively deposited to be fixed to the upper substrate in a beta configuration. The lower substrate 40 and the upper substrate together with a spacer (not shown) form the outside of a vacuum tube.

A process for making an upper substrate is as follows:

First, a transparent conductive layer having a thickness of about 2000 to 3000 angstroms is heated by a positive electric potential and is applied by sputtering. Then a phosphor layer is formed by depositing the phosphor (ZnO:Zn) by screen printing as used in forming a thick film or slurry. At this time, a green phosphor ($Zn_{0.65}Cd_{0.35}S$:Ag,Cl), a yellow phosphor ($Zn_{0.2}Cd_{0.8}S$:Ag,Cl) and a blue phosphor (ZnS:Ag,Cl) are respectively used when applied to colour display. Spacers are formed by thick-film screen printing to leave about 200 micrometers space between a surface of the phosphor layer and the surface of the gate electrode. Afterwards, the upper, lower substrate and spacers are attached to one another by using a frit paste, where the frit is melted. A high vacuum of less than $1.0\times10^6$ Torr is produced inside the layers attached by the above-mentioned process. Then, when the inside of the panel is electrically connected to a circuit driver of the outside panel, the formation of an electron emission display is completed.

The operation of the electron emission display made by the above-mentioned process is as follows:

Responding to display signals, a predetermined electric potential difference is given between a plurality of cathodes in accordance with the directions of the pixel rows and a plurality of gates in accordance with the direction of the lines. A pixel or a cone-shaped field emission device is driven in a matrix, so that the electron emitted from the necessary pixel is struck to emit light to the opposite phosphor layer and then an image in accordance with the display signal displayed. At this point, the electric potential difference between the gates and the cathodes is generally around 80 volts, and about 200 volts is applied to the transparent conductive layer.

The field emission device in accordance with the preferred embodiment of the present invention overcomes the problem of breakage of the cathode tips due to a current concentration which is excessively applied to a predetermined portion. It overcomes this problem by adjusting the current flowing to the cathode to a predetermined range so that uniformity of the emission brightness and stability of the cathode tip can be obtained.

What is claimed is:

1. A method for making a field emission cathode comprising the steps of:

depositing a cathode electrode on a substrate;

depositing an insulating layer on top of the deposited cathode electrode;

depositing a gate electrode on top of the deposited insulated layer;

forming a cavity through the deposited gate electrode and insulating layer;

depositing a parting, layer on the gated electrode layer and the opening perimeter for narrowing the opening;

Then forming a truncated buffer layer on the cathode electrode by deposition of a material from a source outside the cavity while the cavity opening is being simultaneously narrowed, thereby giving a conical shape to the buffer layer;

forming a field emission cathode tip on the truncated buffer layer by deposition of metal from a source outside the cavity while the cavity opening is being simultaneously narrowed to complete closure, thereby giving a conical shape to the cathode tip; and then removing the parting layer and all layers deposited on it.

2. A method for making a field emission cathode comprising:

a first main step comprising steps of:

depositing a cathode electrode on a substrate, depositing an insulating layer on top of the deposited cathode electrode, depositing a gate electrode on top of the deposited insulating layer, and forming a cavity through the deposited gate electrode and insulating layer;

a second main step of depositing a metal parting layer on top of the deposited gate electrode layer and on the perimeter of the gate electrode layer forming the cavity opening, thereby narrowing the opening;

a third main step of forming a truncated buffer layer on the cathode electrode by deposition of a metal through the cavity opening from a source outside the cavity, which forms a simultaneous barrier layer on the parting layer, narrowing the cavity opening as the barrier layer thickness increases, resulting in the simultaneous decrease in the diameter of the truncated buffer layer being formed on the cathode electrode;

a fourth main step of forming a cone-shaped field emission cathode tip on the truncated buffer by deposition of a metal through the cavity opening from a source outside the cavity, which simultaneously forms another barrier layer on top of the barrier layer deposited during the third main step, narrowing to complete closure the cavity opening as the barrier layer thickness increases, thereby simultaneously decreasing the diameter of the material being deposited on top of the truncated buffer formed in the third main step to a point when the opening is just about closed; and a fifth main step of removing the parting layer with all barrier layers attached.

3. A method as recited in claim 2, wherein the cavity portion in the insulating layer is of larger diameter than the cavity portion in the gate electrode layer.

4. A method as recited in claim 2, wherein the cavity portion in the insulating layer has a trapezoidal cross-section with the smaller diameter side on the insulating layer/cathode electrode interface and wherein the portion of the cavity on the gate electrode has a smaller diameter than the smallest diameter of the cavity portion in the insulating layer.

5. A method as recited in claim 2, wherein the cavity is formed using an etching process.

6. A method as recited in claim 2, wherein the second main step further comprises the step of inclining the sample created under the first main step to a sufficient angle relative to the cavity central axis to allow for deposition of the parting layer on the cavity perimeter on the gate electrode.

7. A method as recited in claim 6, wherein the angle of inclination of the sample is approximately 75 degrees.

8. A method as recited in claim 6, wherein the parting layer is deposited using an e-beam evaporator.

9. A method as recited in claim 2, wherein the truncated buffer deposited in the third main step is selected from the group consisting of $SiO_2$, $In_2O_3$ and $SnO_2$.

10. A method as recited in claim 2, wherein the truncated buffer formed in the third main step is deposited using an e-beam evaporator.

11. A method as recited in claim 2, wherein the cathode tip formed in the fourth main step is deposited using an e-beam evaporator.

* * * * *